United States Patent [19]

Seragnoli

[11] 4,142,622

[45] Mar. 6, 1979

[54] STORAGE UNIT FOR COMPENSATING PRODUCTION IMBALANCES BETWEEN CIGARETTE-MANUFACTURING MACHINES AND A PACKETING MACHINE

[75] Inventor: Enzo Seragnoli, Bologna, Italy

[73] Assignee: G.D. Societa per Azioni, Bologna, Italy

[21] Appl. No.: 785,688

[22] Filed: Apr. 7, 1977

[30] Foreign Application Priority Data

Apr. 12, 1976 [IT] Italy ..... 3398 A/76

[51] Int. Cl.[2] ..... B65G 1/12

[52] U.S. Cl. ..... 198/347; 198/358; 198/855

[58] Field of Search ..... 198/347, 358, 502, 524, 198/569, 571, 572, 573, 855, 856, 356; 131/21 A, 21 B, 25

[56] References Cited

U.S. PATENT DOCUMENTS

| | | | |
|---|---|---|---|
| 2,535,866 | 12/1950 | Rasmussen | 198/569 |
| 3,122,231 | 2/1964 | Pence et al. | 198/347 |
| 3,297,138 | 1/1967 | McCombie | 198/572 |
| 3,305,128 | 2/1967 | Dearsley | 198/347 |
| 3,433,347 | 3/1969 | Molins et al. | 198/347 |
| 3,472,358 | 10/1969 | Poupin | 198/347 |
| 3,620,349 | 11/1971 | McCombie | 198/358 |
| 3,749,326 | 7/1973 | Aro | 198/569 |
| 3,885,683 | 5/1975 | Bornfleth et al. | 198/347 |
| 3,921,790 | 11/1975 | Hinchcliffe et al. | 198/347 |
| 3,923,146 | 12/1975 | Van Hall | 198/347 |

FOREIGN PATENT DOCUMENTS

| | | | |
|---|---|---|---|
| 2500526 | 9/1975 | Fed. Rep. of Germany | 198/347 |
| 2504873 | 8/1976 | Fed. Rep. of Germany | 131/25 |
| 1091828 | 11/1967 | United Kingdom | 198/347 |

OTHER PUBLICATIONS

S5611 Research Disclosure No. 125, Sep. 1974, 12508.

*Primary Examiner*—Robert B. Reeves
*Assistant Examiner*—Richard K. Thomson
*Attorney, Agent, or Firm*—Karl F. Ross

[57] ABSTRACT

The storage unit, to be used in conjunction with direct-feed plants for manufacturing cigarette packets, comprises a duct inclined to the vertical for feeding the cigarettes to the hopper of the packeting machine and a plurality of chambers extending perpendicularly to said duct, each having an end wall movable to change the volume of the related chamber. Drives are connected to each movable wall and are controlled by means responsive to the cigarette pressure sensed inside the inclined duct.

12 Claims, 9 Drawing Figures

STORAGE UNIT FOR COMPENSATING PRODUCTION IMBALANCES BETWEEN CIGARETTE-MANUFACTURING MACHINES AND A PACKETING MACHINE

BACKGROUND OF THE INVENTION

The present invention relates to a storage unit for compensating production imbalances between cigarette-manufacturing machines and a packeting machine, in a direct-feld plant for making packaged cigarettes.

In particular, the present invention relates to a storage unit as above referred to, and of the type having at least an inlet connectible to an outlet of at least one manufacturing machine, and at least one outlet connectible to an inlet hopper of a packeting machine.

DESCRIPTION OF THE PRIOR ART

Plants in which cigarette packets are made, i.e., the plants comprising at least one cigarette making machine and a packeting machine, may be assigned, in principle, to two distinct categories, depending upon how the cigarettes are fed from each cigarette-making machine to the packeting machine.

In the first category are the so called "indirectly fed plants," i.e., those wherein the cigarettes made by each machine are collected in containers, which are then emptied into an inlet hopper of the packeting machine; in this machine the cigarettes are formed into groups and arranged in a predetermined way, to be then delivered to the packeting line of the same machine.

In the second category are the plants which will be considered in the present disclosure, i.e., the so called "directly fed plants," wherein the outlet of each cigarette making machine is connected in a substantially direct way with the inlet hopper of the packeting machine, and the cigarettes are delivered in a substantially continuous manner from each cigarette making machine to the packeting machine.

For a long time, in the past, the feeding of cigarettes from the outlet of a cigarette-making machine to the inlet hopper of the packeting machine, was usually performed by transferring means, comprising rather long feeding ducts, having widths substantially equal to the length of a cigarette, and across which the stacked cigarettes were conveyed.

Such a feeding system, wherein a plurality of cigarette layers, resting the one on the other, are fed along a predetermined path, will be hereinafter called by the term "mass feeding of cigarettes."

The ducts as above stated, owing to their cross-section and length, functional not only as cigarette conveyors, but also, at least partly, as reservoirs or compensating containers, for the compensation of possible imbalances between the cigarette-making machines and the packeting machine, which are usually caused by an accidental stopping or stalling of one of said machines. Otherwise stated, these not only effected a "mass feeding of cigarettes" but also a "mass compensation of cigarettes" was attained, owing to the changes in the pressure acting on the cigarettes inside of the ducts and thus in the number of cigarettes momentarily (instantaneously) present therein.

However, many drawbacks were associated with the use of feeding means like those as described above. The most significant drawback was that, due to relatively long stay of cigarettes within the ducts and also owing to the stresses to which the cigarettes were subjected inside of the ducts (e.g., stresses caused by the weight of superposed cigarettes, by the rubbing and rolling of cigarettes in contact with the duct walls and/or with adjacent cigarettes, as well as by the compression and relaxation resulting from possible imbalances between the operations of machines installed upstream and downstream, respectively, of the ducts), substantial deterioration occurred in the structures of the cigarettes, which usually resulted in a loss in dimensional stability, caused both by a decrease in the packing of tabacco within the paper, and by an escape of tobacco from either cigarette end.

Directly fed plants were devised to prevent the abovestated drawbacks.

In such plants, the "mass feeding of cigarettes" was replaced by a "feeding of single cigarettes," performed by conveyors, usually formed with seats in each of which a single cigarette, disposed transversely of the direction of advance, was accommodated. Since such conveyors were obviously not able to act also as compensating reservoirs for the compensation of production imbalances of the machines connected to opposite ends thereof, it was planned to arrange a compensating reservoir or magazine upstream of the inlet hopper of the packeting machine. To such a purpose, recourse was made to vertical containers having an adjustable capacity acting as compensting reservoirs and within which a relatively large number of stacked cigarettes could be accommodated.

Otherwise stated, a hybrid solution was adopted in such direct feeding plants, i.e., a solution consisting of a combination of "single-cigarette feed" and of "mass compensation of cigarettes".

However, this hybrid solution did not prove itself suitable to prevent a structural degrading of cigarettes in the course of their direct conveyance from the cigarette making machine to the packeting machine. Indeed, since large numbers of cigarettes were stacked inside of the compensating reservoirs, they were subject to the very same stresses as were suffered inside of the previously mentioned feeding ducts and which were so injurious to the cigarettes.

Consequently reliance was placed more and more upon sophisticated plants wherein both the feeding and the compensating were made "by single cigarettes."

One of the more advanced, and undoubtedly also most efficient of these plants is disclosed in other applications by applicant herein.

In such a plant, the cigarettes produced by each making machine, are conveyed to the packeting machine arranged side by side, transverse to the direction of conveyance, and along a first stretch.

A second stretch, parallel to a portion of said first stretch, extends across a compensating reservoir, that consists of a cylindrical drum, rotatable about its own axis, and formed with a plurality of axially directed grooves, having a width and depth substantially equal to the diameter and length, respectively, of a cigarette, the length being also adjustable.

Each one of these grooves is designed to accommodate a row of cigarettes in side by side relationship and radially extending with respect to the drum, so that each pre-established angular position of drum defines a portion of said stretch.

The problem of feeding cigarettes from one or more cigarette making machines to a packeting machine is solved in an ideal manner by the direct-feed plant as above referred to, not only because both the feeding and the compensation are performed "by single cigarettes," but also because, since a portion of said stretch is defined by the above described magazine, the principle of "first in, first out" is wholly achieved by it, thereby preventing all drawbacks which may derive from a relatively long stay of cigarettes inside a reservoir.

At this point, it is essential to observe that the attainment of above results requires that very high precision be met by all machines, whereby a plant according to these teachings is relatively expensive.

Such plants should be able to perform all required operations, acting not on a heap of cigarettes, that may be advanced at a relatively low speed, but on a row of side by side cigarettes, which is to be advanced at a relatively high speed to meet the production capacity of modern packeting machines. The throughput of latter machines can be up to 400 cigarette packets per minute so that all devices installed between them and the cigarette-making machines must be able to accurately operate on a row of cigarettes moving at a rate of 130 or more cigarettes per second.

Lately, the attempt to reduce installation costs has led to consideration of hybrid feeding systems, i.e., those consisting of a combination of "single cigarette feeding" and of "mass compensation."

Since all drawbacks of already known systems of the type referred to, substantially depend, as already stated, on the "mass compensation of cigarettes," the above problem may be reduced to that of designing a compensating reservoir capable of operating with heaps of cigarettes, but conceived in such manner as to reduce or even to wholly prevent, during storage, all of the stresses which may result in an unacceptable deterioration of the cigarettes.

SUMMARY OF THE INVENTION

The above problem is splendidly solved by this invention, which provides a magazine unit for compensating possible imbalances between the cigarette-making machines and a packeting machine, in a plant of the direct-feeding type for the production of cigarette packets. The magazine unit has at least one inlet that can be connected, by conveyor means, with an outlet of at least one cigarette-manufacturing machine, and at least one outlet that can be connected with an inlet hopper of the packeting machine. According to the invention the magazine comprises at least one duct inclined to the vertical and extending between said inlet and said outlet. A plurality of variable volume chambers, disposed one above another, extend in a direction substantially perpendicular to the duct and are in communication therewith through the upper end thereof. Each chamber is defined by two superposed movable side walls, substantially perpendicular to the duct and is delimited on the side opposite the duct by an end wall secured to the pair of side walls and movable therewith, whereby to change the capacity of the respective chamber. Drive means is connected with each pair of movable walls, to shift the respective end wall toward and away from the duct, while control means is responsive to the pressure exerted by the cigarettes inside of said duct, to operate the drive means and, cause an increase in the capacity of at least one of the chambers, when a first, predetermined value is exceeded by the pressure and to decrease the capacity of at least one of the chambers when the pressure falls below a given second value, smaller than said first value.

BRIEF DESCRIPTION OF THE DRAWINGS

The further objects and advantages of the invention will be better appreciated from a consideration of the following description, reference being made to the accompanying drawings.

In the drawing.

DESCRIPTION OF THE PREFERRED EMBODIMENT

Figure 1:
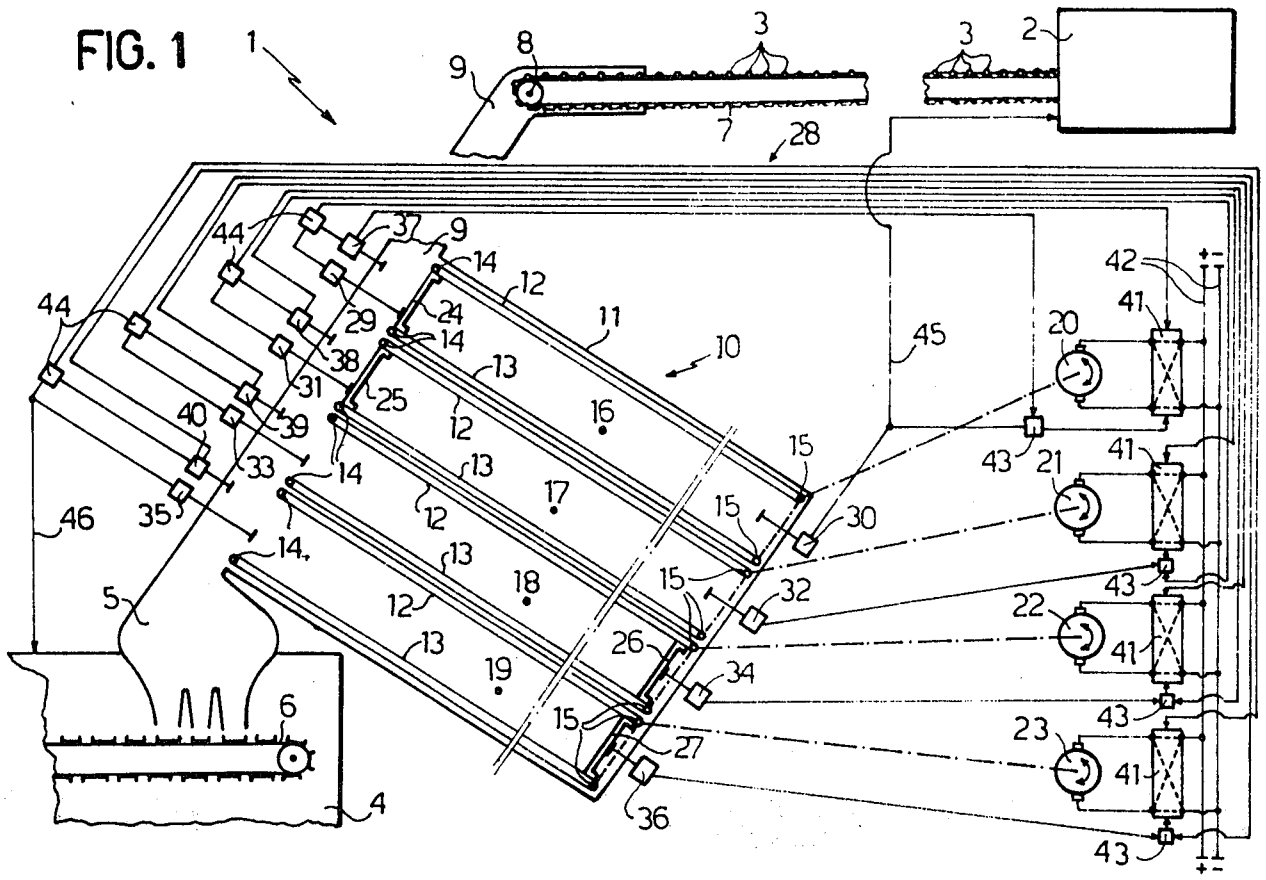
FIG. 1 diagrammatically shows a magazine unit designed according to teachings of this invention, along with a block diagram of a first embodiment form of a feeding and control circuit for this unit.

FIG. 1 shows a plant for the production of cigarette packets and comprising a manufacturing machine 2, for making cigarettes 3, starting from dressed and cut tobacco leaves, and a packeting machine 4.

The inlet of the packeting machine 4 consists of a hopper 5, inside of which the cigarettes 3 are arranged in groups formed each by a pre-established number of cigarettes, these groups being fed to a wrapping and packeting line 6 of machine 4.

Fitted at the outlet of the cigarette-manufacturing machine 2 is an endless conveyor 7 formed with seats in which single cigarettes 3, extending transversely to the conveying direction, are accommodated.

The conveyor band 7 is reversed about a pulley 8, fitted inside of the upper end of a downwardly inclined duct 9 whose lower end leads to the upper end of hopper 5 which is of the width of said duct viewed in a direction orthogonal to the plane of FIG. 1, substantially equal to the length of cigarettes 3.

The duct 9 forms a part of a magazine unit 10, designed to compensate for the possible imbalances between the output of the cigarette manufacturing machine 2, and operating rate of the packeting machine 4.

The magazine unit 10 consists of a substantially prismatic shaped casing 11, having a width equal to that of duct 9 and inside which four pairs of conveyor band 12 and 13 are fitted. Each band is led about two pulleys 14 and 15 and extends downwardly in a direction orthogonal to axis of duct 9 from a side edge thereof to an end wall of casing 11.

Four elongated chambers 16, 17, 18, 19, downwardly inclined from the duct 9 and extending perpendicular to the axis thereof are formed between the lengths of bands 12 and 13 which face each other.

Four reversible electric motors 20, 21, 22 and 23 are each operatively connected with a first of pulleys 15 of each pair of conveyor bands 12 and 13, while each second pulley 15 is mechanically coupled with the respective first pulley 15 to rotate at the same speed of the latter pulley, but in an opposite direction, so that the confronting lengths of each pair of bands 12 and 13 are driven at equal speeds and in the same direction.

Four walls 24, 25, 26 and 27 having, when seen in plan view, a shape substantially equal to cross-section of chambers 16, 17, 18 and 19, extend crosswise thereto, and are connected each with the facing lengths of the respective pair of bands 12 and 13 so as to be moved along with same bands with two opposite side edges thereof substantially into contact with two vertical side walls (not shown) of casing 11.

The motors 20, 21, 22 and 23 are fitted with a control circuit, indicated by the numeral 28, and comprising four pairs of end-stroke detectors 29 and 30, 31 and 32, 33 and 34, 35 and 36, to stop the associated motors 20, 21, 22 and 23, when the uppermost and lowermost positions, respectively, have been attained by the movable walls 24 25, 26 and 27, within the respective chambers 16, 17, 18 and 19. There are four further detectors 37, 38, 39 and 40, and each has two outputs to reverse the direction of rotation of the associated motors 20, 21, 22 and 23, in response to the pressure prevailing inside of duct 9, i.e., at the upper ends of chambers 16, 17, 18 and 19.

Each detector 37, 38, 39 and 40 is designed to send a first signal through a first output when a given first threshold value is exceeded by the pressure in duct 9, while a second signal is sent through the second output when the pressure at the same point falls below a pre-established second value, smaller than the first value.

The control signals sent from each detector 37, 38, 39 and 40 are applied to a three-positions change-over box 41, which has one side connected with two main conductors 42, while the opposite side is connected with the terminals of related motors 20, 21, 22, 23. The unit 41 keeps a motor connected with the main conductor 42 and drives it in either direction of rotation according to whether a first or a second switch-over signal is received. These two signals are applied to box 41 by two conductors, extending across two consent gates 43 and 44, the first of which is connected with the associated detectors 30, 32, 34, 36, while the second gate in connected with the associated detectors 29, 31, 33, 35, in such a manner that a control signal is not allowed to pass through the respective gates 43 and 44 when an inhibiting signal is applied thereto by the related detector. Such inhibiting signals are sent out by the detectors when they are activated by the associated movable walls 24, 25, 26, 27. In particular, the signals generated by the detectors 30 and 35, are applied not only to consent gates 43 and 44, but also, through the conductors 45 and 46, to the cigarette-manufacturing machine 2 and to packeting machine 4, respectively, thus stopping these machines.

The above described plant 1 operates as follows:

Before starting the machines 2 and 4, the duct 9, the hopper 5, and usually two of the chambers 16, 17, 18 and 19— preferably the chambers 18 and 19—, are filled by hand with cigarettes 3, suitably stacked perpendicularly to the plane of the paper in FIG. 1. For this purpose, the walls 24, 25, 26, 27 are previously brought in the positions shown in FIG. 1.

Now, the machines 2 and 4 are started, and their production capacity is programmed in such a manner that the number of cigarettes that are fed by the conveyor 7 to duct 9 is always equal to number of cigarettes handled by the machine 4, i.e., to the number of cigarettes introduced into the hopper 5.

Since the production capacity of machine 4 is usually larger than that of machine 2, it is always possible to install one or more further conveyors (not shown), similar to conveyor 7 and in parallel therewith, connected each with a further packeting machine (not shown). At the rated capacity, there is a continuous flow of cigarettes through the duct 9, and the cigarette pressure within it, at least close to detectors 37 and 38, is at a substantially constant level, intermediate between said previously stated first and second pressure values.

Should at a given moment of the operation, the action of packeting machine be slowed down or even stopped, then the pressure inside of duct 9 will increase, due to continuous flow of cigarettes from the machine 2.

Then, when said first value is exceeded by the pressure exerted on the detector 38, from the first output thereof a signal is given, which is applied to the input of related change-over box 41, thereby starting the motor 21, by which the wall 25 is moved toward the bottom of chamber 17.

Thus, the cigarettes that keep on flowing into the duct 9, are discharged into the chamber 17, whose capacity is gradually increased.

Should the slowing- down or stoppage of machine 4 persist, then the wall 25 is shifted downwardly until the detector 32 is operated, thereby giving a signal, by which the inhibiting signal that prevents the passage through the respective box 43 of signal sent by the detector 38 is neutralized, whereby the related box 41 is switched-over to its neutral position, thus stopping the motor 21.

The end of expansion of chamber 17 is directly followed by an increase in the pressure exerted on the detector 37, whereby the motor 20 is started, by which the wall 24 is moved downwardly, with a consequent increase in the capacity of chamber 16.

When the detector 30 is activated by the wall 24, the signal which is there by sent out, not only prevents the passage of a signal generated by the detector 37 through the box 43, thus stopping the motor 20, but is also applied, through the conductor 45, to machine 2, thereby discontinuing the operation thereof.

Obviously, should the correct operation of machine 4 be re-started at any moment before the machine 2 is stopped, then the wall 17 or 16 would be retained in an intermediate position, as soon as the pressure exerted on the related detector 38, 37 falls below the first pressure value, thereby discontinuing the transmission, by related detector 38, 37, of the signal by which either motors 21, 20 are kept in operation.

Let us suppose that, to begin with the position as shown in the FIG. 1, the machine 2 is slowed down or even stopped, while the machine 4 keeps on taking cigarettes from the channel 9; the pressure therein is progressively reduced.

When the pressure acting on the detector 39 falls below the stated second value, a signal is generated by the detector 39 through its second output, and is applied to the respective block 41, which is thereby switched over, thus starting the motor 22 in a direction of rotation by which the wall 26 is shifted upwardly whereby the machine 4 can be fed with the cigarettes contained within the chamber 18. Should the failure of machine 2 persist, then the wall 26 is shifted until the detector 33 is activated, whose output signal, applied to the respective block 44, prevents the signal sent out by the detector 39 from passing therethrough, thus switching the block 41 over to its neutral position thereby stopping the motor 22.

The stopping of the latter motor 22 is directly followed by a drop in the pressure which is exerted on the detector 40, whereby the motor 23 is started, and thus the chamber 19 is gradually emptied.

If the correct operation of machine 2 is not reestablished, then the detector 35 is activated by the wall 27, whereby an inhibiting signal is sent out, which not only prevents the signal as generated by the detector 40 from passing through the respective circuit block 44, thereby stopping the motor 23, but is also applied, through the conductor 46, to machine 4, thus discontinuing the operation thereof.

From a consideration of the structure of magazine unit 10, it is possible to directly appreciate that it has been devised in such a manner as to minimize all of the stresses that may be suffered by the cigarettes in the course of the storage thereof and that may result in a deterioration or degrading of them.

Indeed, firstly the relatively large volume of casing 11 is subdivided into a plurality of chambers (four chambers in the example, which may however be provided in a greater or lesser number), to distribute the heaped cigarettes, while leaving substantially unchanged the capacity. Moreover, the slightly inclined position (i.e., not vertical) of chambers allows reduction of the weight on the lower cigarette layers.

Not only the end wall 24 (25,26,27) but also the top and bottom walls of each chamber are movable; consequently, when each chamber is filled and emptied, the cigarettes are moved crosswise in mass, without rolling one on top of another.

The fact that a mutual rolling of cigarettes is prevented is a very important factor, since it is universally known that a loss in the consistency of tobacco inside of a cigarette occurs when a cigarette is rolled under slight pressure.

It is moreover important to observe that a correct adjustment of circuit 28 allows reduction to a negligible minimum of the pressure changes to which the stored cigarettes may be subjected, thereby removing a source of fatigue stresses.

Figure 2:
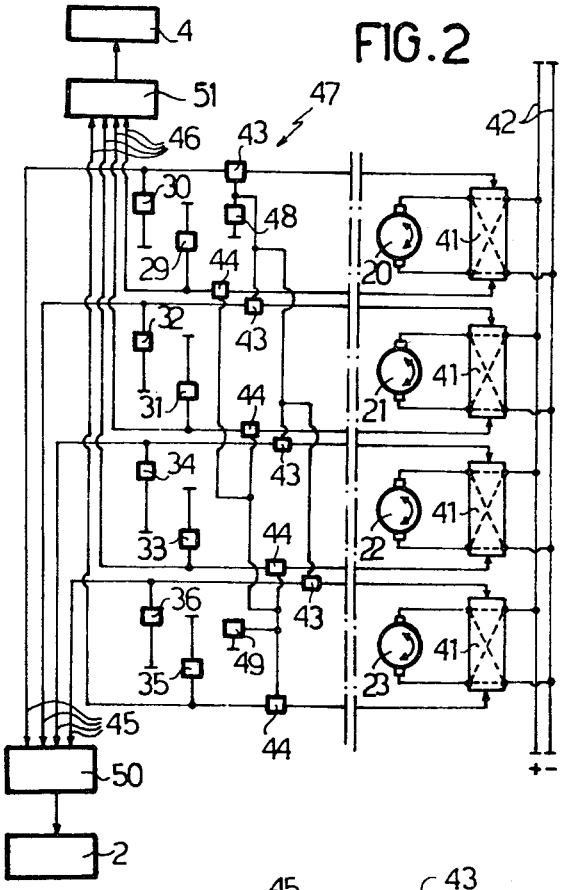
FIGS. 2, 3 and 4 are block diagrams of a first, a second and a third variant respectively, of the control circuit shown in FIG. 1.

FIG. 2 shows a control circuit 47, which is substantially similar to circuit 28, except for the fact that the detectors 37, 38, 39 and 40 are replaced by two detectors 48 and 49 with a single output. The detector 48 is fitted substantially in place of detector 37 and connected with all circuit blocks 43, while the detector 49 is fitted substantially in place of detector 40 and connected with all circuit blocks 44. A signal is generated by the detector 48 only when the pressure prevailing on top of duct 9 exceeds the stated first value, while a signal is generated by the detector 49 only when the value of pressure prevailing at the bottom same duct 9 falls below the stated second value.

When a circuit control similar to circuit 47 is utilized, then the motors 20, 21, 22 and 23 are operated always jointly in either direction.

Consequently, in such a case, it would be possible to utilize one motor only and replace all other motors, e.g., by a train of gears.

When, as shown in FIG. 2, a motor is provided for each of chambers 16 to 19 inclusive, it is preferable to connect the output of each circuit block 43, and the output of each box 44, with logical gates 50 and 51, respectively, which are designed in such a manner as to send signals for the stopping of the cigarette manufacturing machine 2 and of packeting machine 4, respectively, only after the signals coming from all blocks 43 and 44 are applied thereto.

Thus, all troubles that may be caused by possible differences in the motor speeds, can be prevented.

Figure 3:
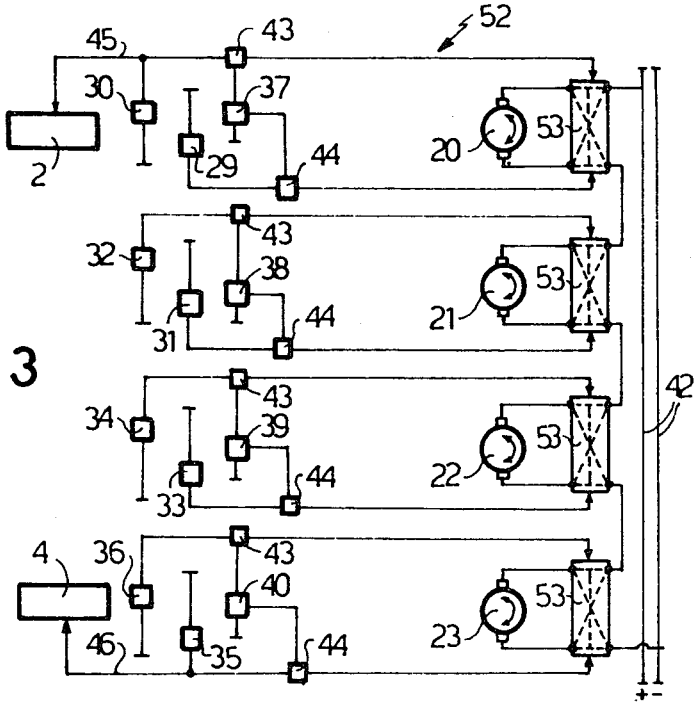

FIG. 3 shows a control circuit 52 which is similar to circuit 28, being however able to control the motors 20, 21, 22 and 23, when they are series connected, rather than parallel connected, with the mains 42.

For this purpose, the change-over circuits 41 of circuit 28 are replaced by similar blocks 53, in which the intermediate position is a by-pass position instead of being a neutral or blocking position, as in the blocks 41.

Figure 4:
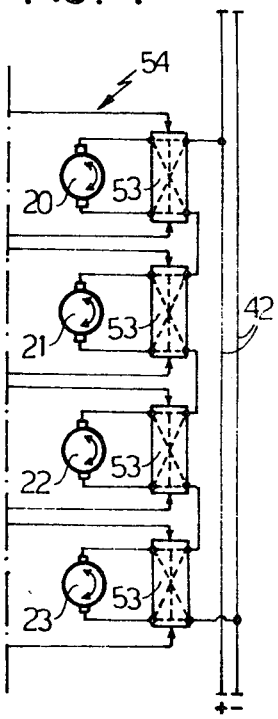

FIG. 4 shows a control circuit 54 which is similar to circuit 47, as shown in FIG. 2, but is able to control the motors 20, 21, 22 and 23 when they are series connected, as shown in the diagram of connections of FIG. 3.

Obviously, apart from the control circuits as shown, the possibility exists to utilize further circuits, obtained by simple modifications made in the control circuits 28 and 52, and adapted to cause the magazine unit 10 to operate in a manner different from that as described above. Thus, e.g., it is possible to have all, or some of motors 20–23 operated jointly in the course of filling, or emptying steps, and to have the same motors operated separately in the course of the other of said two steps.

Shown in FIGS. 5 to 8 inclusive is a magazine unit 10, which is particularly advantageous, due both to compactness of its design, and to the ease with which it can be displaced and connected with a packeting machine 4 on one hand, and with the outlet conveyors 7 of a cigarette manufacturing machine 2 on the other hand, and moreover owing to design and arrangement of their components, by which a relatively high reliability, and a relatively low cost are ensured.

Figure 5:
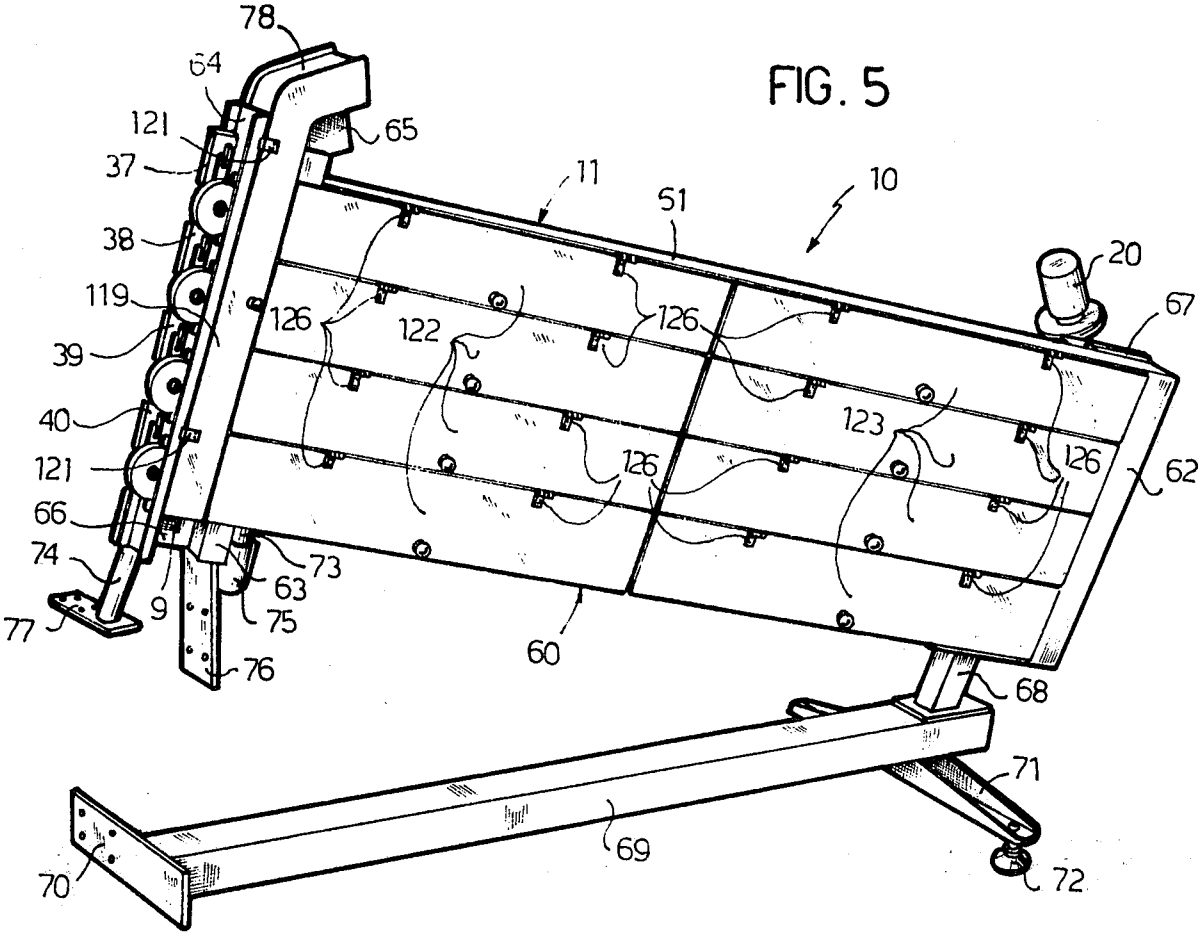
FIGS. 5 and 6 are perspective views of an embodiment of a magazine unit as shown in FIG. 1.
Figure 6:
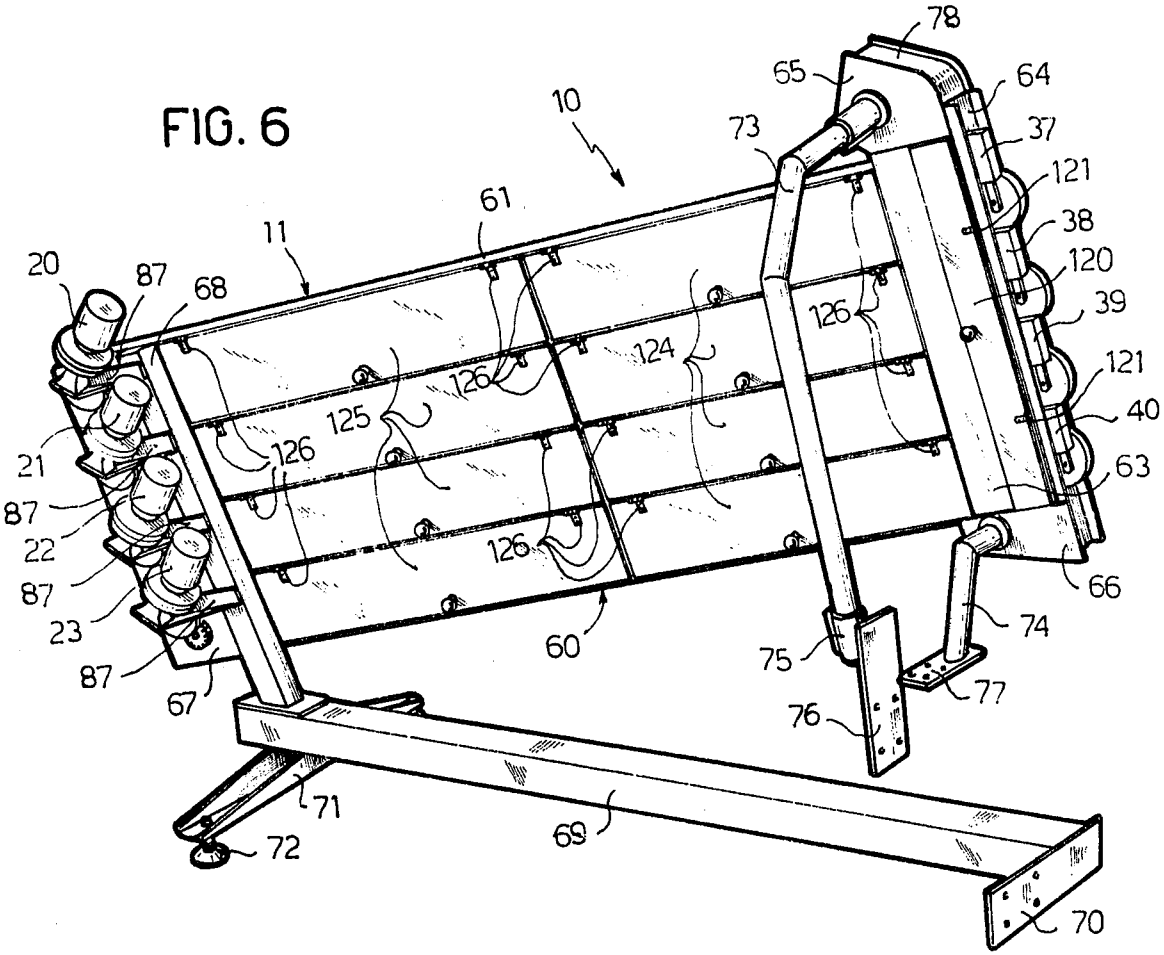

As shown in FIGS. 5 and 6, the casing 11 of magazine unit 10 comprises a bottom wall 60 and a top wall 61, parallel with each other, and connected by a rear member 62, and by a forward C-shaped beam 63, having its opening directed toward said rear member 62, and extending along the inner rear surface (to the right when viewed as in FIG. 5) of duct 9.

The outer forward surface of said duct 9 is partly defined by a C-shaped iron (channel) 54, having its opening directed outwardly, and connected with the beam 63 by an upper side plate 65 and by a lower side plate 66, located on the same side of casing 11.

A third rectangular plate 67 (see FIG. 6) extends along a side surface of member 62 and on the same side of plates 65, 66; fixed to the outer surface of said plate 67 is a tubular beam 68, whose lower end extends below the wall 60, and is connected with a further horizontal tubular beam 69, that extends forwardly below the wall 60 and whose forward end is formed with a plate 70, through which the beam is connected with an outer vertical wall (not shown) of the packeting machine 4.

A cross beam 71, having two adjustable feet 72 by which the magazine unit 10 rests on the floor, is secured at its middle point, to the point where the beam 69 is connected with the beam 68.

The connection of magazine unit 10 with the machine 4 is completed by two tubular arms 73 and 74, extending outwardly from the plates 65 and 66, respectively, and that are bent downwardly. Connected with the lower end of arm 73 is a bush 75, which is sidewise secured to a vertical plate 76, that can be connected with an outer vertical wall (not shown) of machine 4. Fixed to the lower end of arm 74 is a horizontal plate 77, that can be connected with an outer horizontal wall (not shown) of machine 4.

Thus, by means of the arms 73 and 74, and of beam 69, it is possible to have the magazine unit 10 quickly and accurately connected with the inlet end of a packeting machine 4 above hopper 5.

The coupling of open lower end of duct 9 with the open upper end of hopper 5, is allowed by the side plate 66, that can be connected with a side wall of hopper 5.

The coupling of magazine unit 10 with one or more cigarette manufacturing machines 2 is allowed by an upper end length 78 of duct 9 which extends above of upper wall 61 and is bent rearwardly to allow for the introduction, through its open end, of the discharge end of one or more conveyors 7 whose pulley 8 can be fitted inside the length 78.

The web of beam 63 is removed all along the casing 11, to allow for the communication between the duct 9 and the upper end of chambers 16–19.

As previously stated, the tops and bottoms of the latter chambers are defined by the opposite surfaces of inner lengths of a pair of conveyor bands 12 and 13, guided by the pulleys 14 and 15 respectively, and inclined in such a manner as to form an angle preferably ranging from 40° to 45° with the horizontal.

Figure 7:
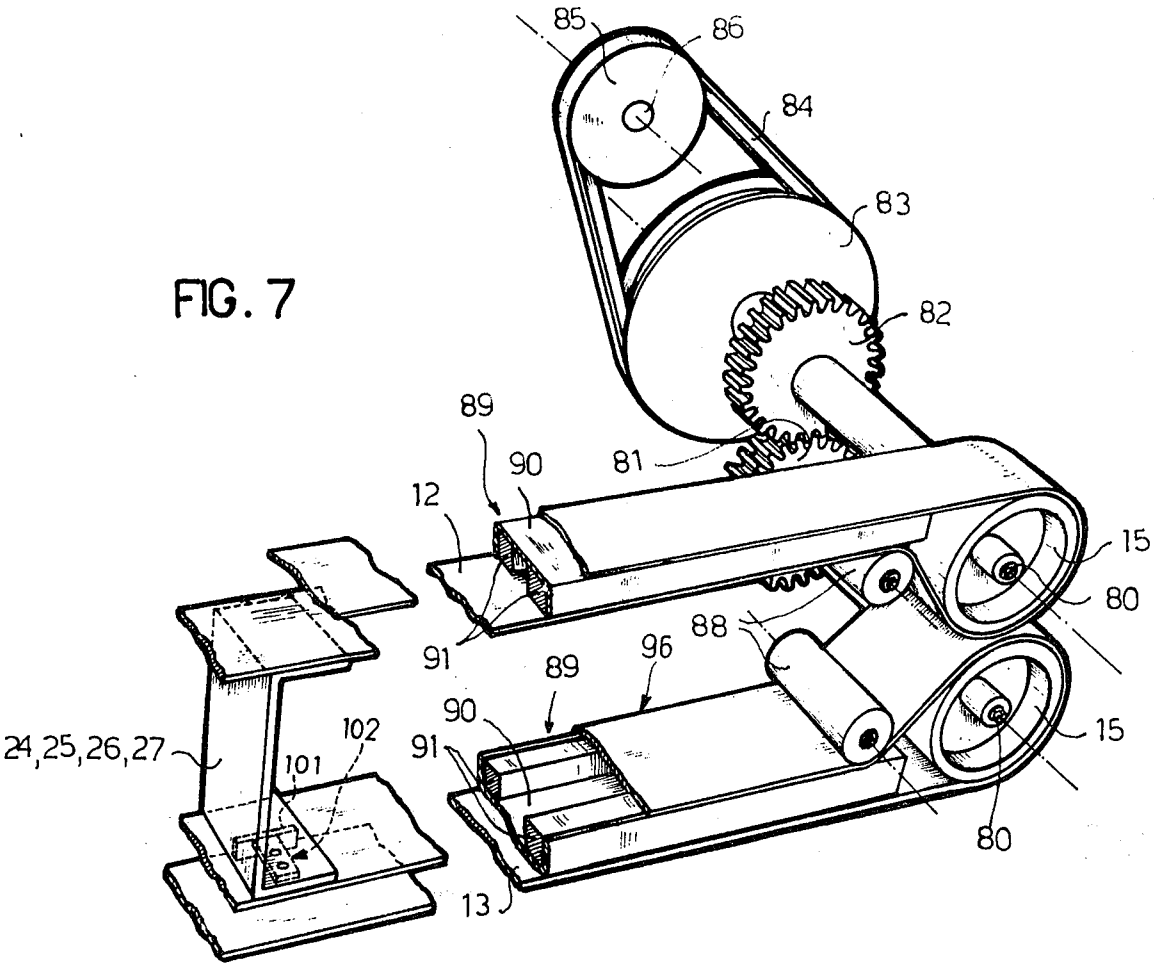
FIG. 7 is a diagrammatic perspective view, on a larger scale, of a first inner detail of the magazine unit as shown in FIGS. 5 and 6.

As shown in FIG. 7, the pulleys 15 of each pair of conveyor bands 12 and 13 are keyed on respective shafts 80, which are rotatably supported (in a manner not shown) by the plate 67; the shafts 80 are coupled with one another by two gears 81 and 82, by which they are driven at the same speed, but in opposite directions.

Keyed on one of said shafts 80 is a pulley 83, which is connected, by a transmission belt 84, with a pulley 85, that in turn is keyed on the output shaft of one of motors 20–23. The motors are secured to outer wall of casing 11 by the brackets 87 (see FIG. 6), fastened to beam 68.

As shown in FIG. 7, the inner length of each conveyor band 12, 13 is deflected, by a baffle roll 88, toward the related outer length, extending thus parallel thereto on the opposite sides of a metal web 89, that represents the load-bearing portion of walls of chambers 16–19. Each metal web 89 comprises a C-shaped iron or channel 90 whose middle portion is in contact with the outer length of related band 12, 13, and whose flanges are reinforced by two longitudinal bars 91 secured to their inner sides. Each web 89 is secured on one side by screws (not shown) to the plate 67 and on the other side to a flange of beam 63 by a screw 92 (see FIG. 8).

Figure 8:
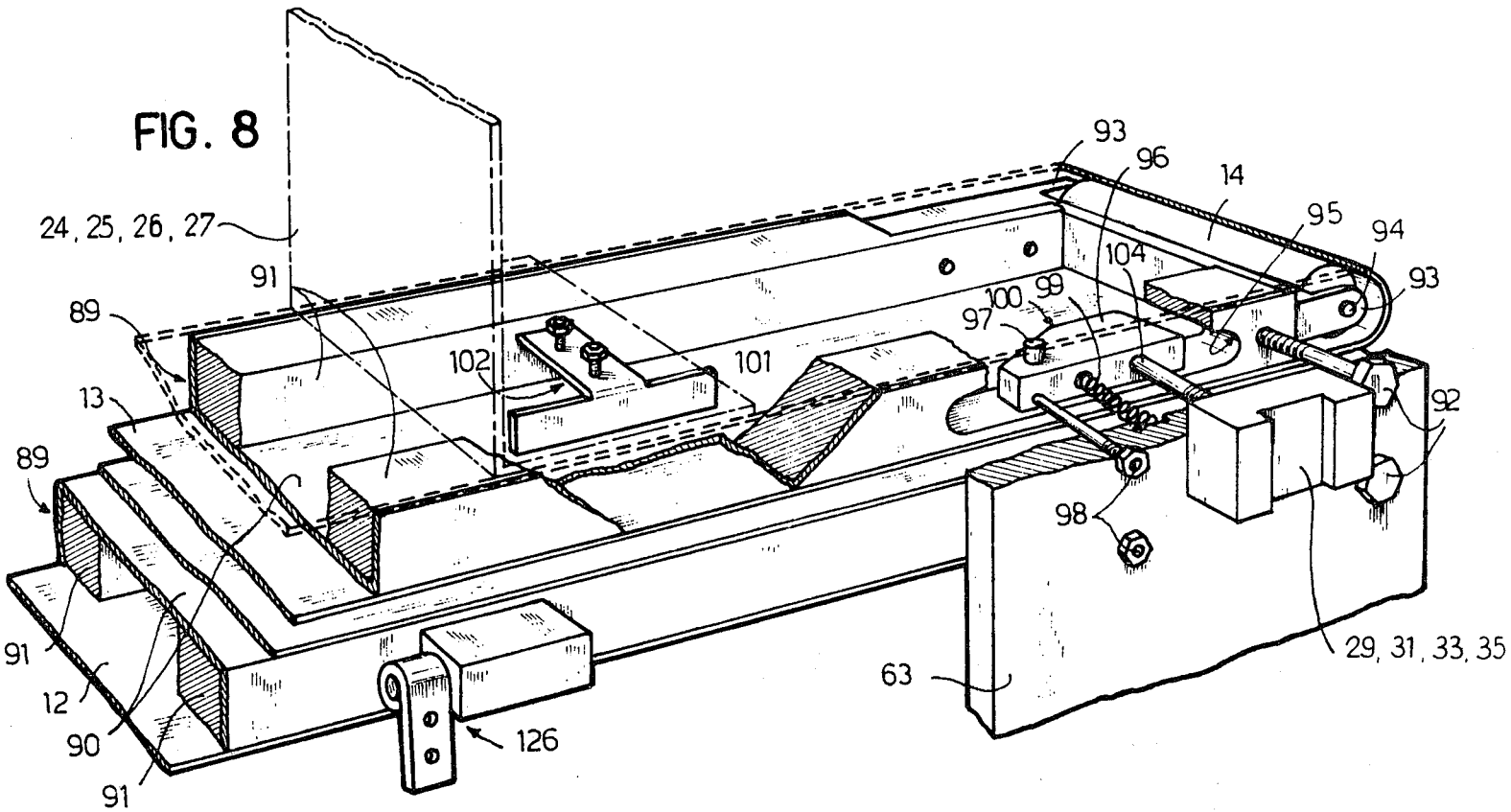
FIG. 8 is a diagrammatic perspective view, on a larger scale, of a second inner detail of the magazine unit shown in FIGS. 5 and 6.

As shown in FIG. 8, two arms 93 are formed at the upper end of each web 89, and a pulley 14 is revolvingly fitted on a shaft 94, supported by said arms 93.

Two elongated openings 95 are formed on both ends of rear flange 91 (viewed as in FIGS. 5 and 7) of web 89 of each conveyor band 13 (see FIG. 8). Fitted inside of openings 95 of each flange 91 are two devices, having a structure symmetrically opposite with respect to a median plane extending therebetween, and perpendicular to bands 12 and 13.

Considering now the device fitted at the end close to inlet of one of chambers 16 to 19, it consists, as it can be readily appreciated, of a block 96 revolvingly supported by a pin 97, that extends perpendicular to the plane of lengths of bands 12 and 13.

Each block 96 is biased toward the inside of its web 89 and against a stop 98, by a spring 99, which is fitted between the block 96 and the stated flange of channel beam 63, and is designed to cooperate, by its inner surface 100, with a plate 101, that form a part of an angle bracket 102, which is secured to inner surface of each band 13 (see FIG. 7) close to respective movable wall 24–27.

As shown in FIG. 8, a block 96 can be turned outwardly by the plate 101, to operate the activating element 104 of a detector (29, 31, 33, 35) supported by the stated flange of beam 63.

What previously has been stated obviously holds also for the detectors 30, 32, 34, 36, located close to bottoms or lower ends of chambers 16 to 19, and operated by the bracket 102, in the second end-stroke position of respective walls 24 to 27.

Figure 9:
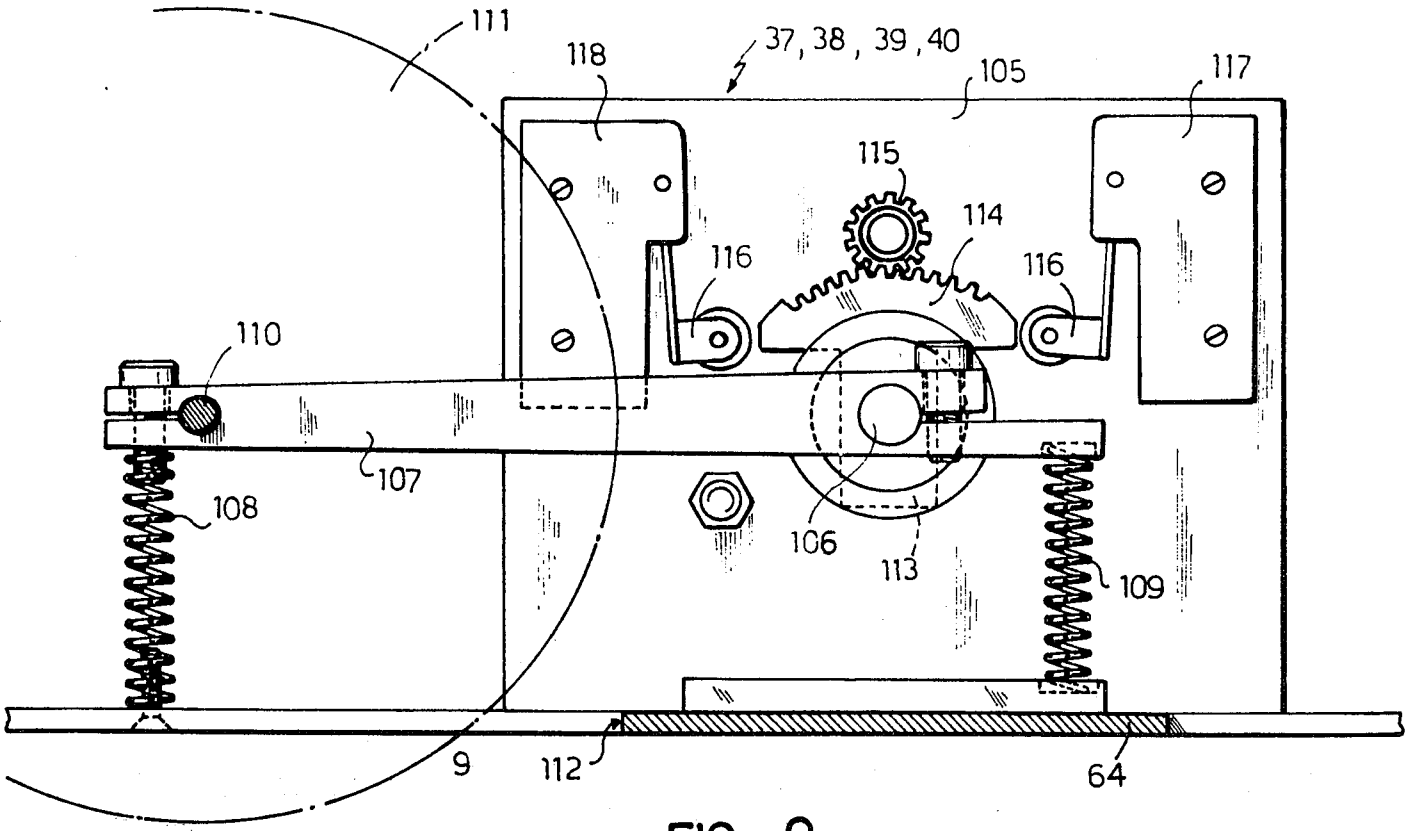
FIG. 9 shows, on a larger scale, a third detail of FIGS. 5 and 6.

As shown in FIGS. 5 and 6, the detectors 37 to 40 inclusive are supported on the outside of duct 9 by the channel iron 64. In particular, as shown in FIG. 9, each detector 37 to 40 comprises a block 105, connected with the channel iron 64; rotatably supported on the block 105 is a shaft 106, whereon a rocker level 107 is keyed, which is maintained in an equilibrium position by two counteracting springs 108 and 109. Fixed to one end of rocker lever 107 is a crosswise extending pin 110 on whose opposite ends two disks 111 are rotatably fitted, a peripheral portion of each disk extending inside duct 9, through a slot 112, with which the channel iron 64 is formed.

Angularly adjustably fitted on the shaft 106 is a plate 113, an upper portion of which is formed as a sector gear 114 in mesh with a pinion 115, by which the angular position of plate 113 can be adjusted. Both opposite ends of sector gears 114 are positioned in front of activator elements 116 by which the two microswitches 117 and 118 are operated. The output terminals of these microswitches are the first and second output, respectively, of detector 37 to 40. The adjustment of the angular position of plate 113, by means of pinion 115, allows regulation, within a pre-established range, of the first and second values of the pressure inside of duct 9, at which the microswitches 117 and 118, respectively, are operated. As shown in FIGS. 5 and 6, moreover, in order to allow for a control of the inner space of casing 11, the opposite side walls of duct 9 are formed with two transparent windows 119 and 120, pivotally connected by the hinges 121, with the flanges of channel iron 64.

The opposite side walls of each chamber 16 to 19 are similarly made of two pairs of transparent windows 122, 123, 124, 125, located side by side. The upper side of each window 122 to 125 is connected by a respective pair of hinges 126 with the side surface (see FIG. 8), of the related web 89.

What we claim is:

1. A direct-feed cigarette-package plant comprising:

a cigarette-packaging machine having an inlet spaced from and disposed below a cigarette-making machine;

a downwardly extending duct between said cigarette-making machine and said inlet for delivering a stream of cigarettes to said inlet; and a storage unit for compensating production imbalances between said cigarette-making machine and said packaging machine, said storage unit comprising:

a prismatic magazine inclined to the horizontal and opening laterally into said duct over at least a portion of the length thereof, said magazine extending downwardly from said duct and lying in a vertical plane, a plurality of pairs of spaced-apart movable belts having confronting stretches defining respective compartments between them, said compartments being inclined to the horizontal and extending perpendicular to said duct, said compartments being spaced apart along the length of said duct in the direction of travel of said cigarettes between said cigarette-making machine and said inlet and having a width corresponding substantially to the length of a cigarette made by said cigarette-making machine, a respective end wall connected to the confronting stretches of each of said pairs of belts for defining the end of each compartment, said end walls being movable with the respective belts to vary the lengths of the respective compartments and thereby vary the respective cigarette-containing capacity thereof, drive means operatively connected with said belts for displacing same to selectively increase and decrease the cigarette-containing capacities of said compartments, and control means connected to said drive means and including:

at least one sensor along said duct responsive to the pressure of cigarettes therein, and circuit means connected to said sensor and defining first and second threshold values of the pressure of cigarettes in said duct whereby said drive means is operated to increase the capacity of at least one of said chambers upon the detection of a pressure exceeding the first value and to decrease the capacity of at least one of said compartments upon the detection of a cigarette pressure in said duct below said second value which is less than said first value.

2. The plant defined in claim 1 wherein said control means further comprises circuit means connected with both of said machines for stopping said cigarette-making machine when the capacity of all of said compartments is reduced to zero and for stopping said packaging machine when all of said compartments are at maximum capacity.

3. The plant defined in claim 1 wherein each of said belts passes around a respective pair of pulleys, one pulley of each pair being connected to said drive means, the corresponding pulley of the other belt of each compartment being operatively connected to the pulley of the same compartment connected to said drive means for rotation of the interconnected pulleys at the same speed but in opposite senses.

4. The plant defined in claim 1 wherein said drive means includes at least one reversible electric motor.

5. The plant defined in claim 4 wherein said drive means includes a respective reversible electric motor for each of said compartments.

6. The plant defined in claim 1 wherein each of said compartments is inclined at an angle of 40° to 45° to the horizontal.

7. The plant defined in claim 1 wherein said magazine comprises a pair of side walls lying in vertical balance and flanking said pairs of belts while defining opposite sides of said compartments.

8. The plant defined in claim 7 wherein at least portions of said side walls are formed with transparent windows which are swingably mounted on the magazine.

9. The plant defined in claim 7 comprising at least one support affixed to said magazine for connecting same to said packaging machine.

10. The plant defined in claim 7 wherein said magazine comprises a substantially horizontal beam and a pair of arms extending outwardly from said magazine close to opposite ends of said duct, the free ends of said arms being provided with connecting plates orthogonal to one another and adapted to be connected orthogonal surfaces of said packaging machine, one end of said beam being connected to said magazine, the other end of said beam being formed with a plate connectible to a wall of said packaging machine.

11. The plant defined in claim 10, further comprising support feet connected to said one end of said beam.

12. The plant defined in claim 7 wherein said inlet is a hopper, said duct being connected to said hopper at its lower end, the upper end of said duct being bent to the horizontal to receive a cigarette conveyor of said cigarette making machine.

* * * * *